US009362065B2

(12) United States Patent
Jang

(10) Patent No.: US 9,362,065 B2
(45) Date of Patent: Jun. 7, 2016

(54) MOLDED CASE CIRCUIT BREAKER

(71) Applicant: LSIS CO., LTD., Anyang-si, Gyeonggi-do (KR)

(72) Inventor: Bong Yun Jang, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 26 days.

(21) Appl. No.: 14/448,524

(22) Filed: Jul. 31, 2014

(65) Prior Publication Data

US 2015/0129551 A1 May 14, 2015

(30) Foreign Application Priority Data

Nov. 8, 2013 (KR) ..... 10-2013-0135801

(51) Int. Cl.

| | |
|---|---|
| ***H01H 9/34*** | (2006.01) |
| ***H01H 9/04*** | (2006.01) |
| ***H01H 71/02*** | (2006.01) |
| ***H01H 73/18*** | (2006.01) |

(52) U.S. Cl.

CPC ..... *H01H 9/342* (2013.01); *H01H 9/047* (2013.01); *H01H 71/0264* (2013.01); *H01H 73/18* (2013.01)

(58) Field of Classification Search

CPC ..... H01H 73/18; H01H 9/02; H01H 9/342; H01H 33/53; H01H 71/02; H01H 9/30; H01H 9/047

See application file for complete search history.

(56) References Cited

U.S. PATENT DOCUMENTS

| | | | | |
|---|---|---|---|---|
| 3,582,966 | A | 6/1971 | Strobel | |
| 4,965,544 | A | 10/1990 | Kelaita, Jr. et al. | |
| 5,150,091 | A | 9/1992 | Hart et al. | |
| 2001/0048354 | A1 * | 12/2001 | Douville | H01H 77/02 335/172 |
| 2005/0219021 | A1 | 10/2005 | Fleege et al. | |
| 2009/0002106 | A1 * | 1/2009 | Harmon | H01H 9/342 335/202 |
| 2011/0090031 | A1 * | 4/2011 | Paek | H01H 71/025 335/172 |
| 2012/0314331 | A1 * | 12/2012 | Ahlert | H01H 71/12 361/102 |
| 2013/0334174 | A1 * | 12/2013 | Wehr | H01H 71/0257 218/157 |
| 2015/0129555 | A1 * | 5/2015 | Jang | H01H 9/04 218/157 |

FOREIGN PATENT DOCUMENTS

| | | |
|---|---|---|
| DE | 4303550 | 8/1993 |
| DE | 19828417 | 7/1999 |

(Continued)

OTHER PUBLICATIONS

Korean Intellectual Property Office Application Serial No. 10-2013-0136461, Office Action dated Sep. 26, 2014, 4 pages.

(Continued)

*Primary Examiner* — Truc Nguyen

(74) *Attorney, Agent, or Firm* — Lee Hong Degerman Kang & Waimey; Jonathan Kang; Jeffrey Lotspeich

(57) ABSTRACT

Disclosed is a molded case circuit breaker. The molded case circuit breaker includes a case; an interrupter assembly installed in the case, and provided with an arc gas outlet for discharging arc gas generated from inside of the interrupter assembly to outside; an exhaustion guiding portion disposed between the interrupter assembly and the terminal portion, and provided with a discharge chamber therein, to thus provide an arc gas passage between the arc gas outlet and a vent chute of the terminal portion; and an exhaustion cover mounted to the case with a structure to cover the exhaustion guiding portion, to thus block the arc gas passage.

12 Claims, 8 Drawing Sheets

(56) References Cited

FOREIGN PATENT DOCUMENTS

| | | |
|---|---|---|
| EP | 1098330 | 5/2001 |
| JP | S58-017755 | 2/1983 |
| JP | 59-177153 | 10/1984 |
| JP | 59-170360 | 11/1984 |
| KR | 20-2012-0008674 | 12/2012 |
| KR | 10-1297515 | 8/2013 |
| WO | 0141168 | 6/2001 |
| WO | 2011/141170 | 11/2011 |

OTHER PUBLICATIONS

Korean Intellectual Property Office Application Serial No. 10-2013-0135801, Notice of Allowance dated Mar. 23, 2015, 2 pages.
European Patent Office Application Serial No. 14179309.1, Search Report dated Mar. 27, 2015, 8 pages.
Japan Patent Office Application Serial No. 2014-171495, Office Action dated Jun. 30, 2015, 3 pages.
Japan Patent Office Application Serial No. 2014-171495, Notice of Allowance dated Jan. 12, 2016, 3 pages.

* cited by examiner

MOLDED CASE CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0135801, filed on Nov. 8, 2013, the contents of which are all hereby incorporated by reference herein in its entirety.

BACKGROUND OF THE DISCLOSURE

1. Field of the Disclosure

The present disclosure relates to a molded case circuit breaker, and particularly, to a molded case circuit breaker capable of preventing a dielectric breakdown due to leakage of arc gas occurring during a short-circuit.

2. Background of the Disclosure

Generally, a molded case circuit breaker (MCCB) is an apparatus provided with a switching mechanism, a trip unit, etc. integrally assembled to each other in a case formed of an insulating material. An electrical path, which is being used, may be open or closed manually or by an electric adjuster provided outside the case. When an overload, a short-circuit, etc. occur, the molded case circuit breaker serves to automatically disconnect the electric path.

If a short-circuit has occurred on a molded case circuit breaker for 3 phases, a trip unit installed in the molded case circuit breaker disconnects an electric path by separating contacts from each other. In this case, arc is generated when the contacts are separated from each other, and the arc gas in a plasma state is discharged to outside through an arc gas vent means provided in the molded case circuit breaker.

FIG. 1 is a perspective view for explaining a vent means for a molded case circuit breaker according to the cited reference D1 of the prior art.

Referring to FIG. 1, arc gas generated from inside of an interrupter assembly 70 is discharged to a chamber region 100 through an outlet 80 provided at a lower end of the interrupter assembly 70. The arc gas is diverged to two sides in the chamber region 100, through a gas divergence portion 100 of a triangular shape. Then the arc gas is discharged to outside through a chute 90.

However, the arc gas discharge structure of D1 (U.S. Pat. No. 7,034,241) has the following problems. When an auxiliary case (not provided in D1) is coupled to a case 190, an arc leaks to a gap between the case 190 and the auxiliary case, on a passage between the outlet 80 of the interrupter assembly 70 and a terminal portion. As a result, an arc conducting path is formed on the surface of the case 190 and the auxiliary case, and thus a dielectric breakdown occurs between conductors and a bottom surface of the case 190. This may cause a dielectric strength against a reference withstand voltage of 2.2 KV, to be lost.

SUMMARY OF THE DISCLOSURE

Therefore, an aspect of the detailed description is to provide a molded case circuit breaker having an integral-type sealing structure, capable of rapidly discharging arc gas discharged from an outlet of the conventional interrupter assembly, to outside, without leakage to a passage generated as a case and an auxiliary case are coupled to each other.

To achieve these and other advantages and in accordance with the purpose of this specification, as embodied and broadly described herein, there is provided a molded case circuit breaker, including: a case; an interrupter assembly; an exhaustion guiding portion; and an exhaustion cover.

The case may be provided with a power side terminal portion and a load side terminal portion to which a power side external terminal and a load side external terminal are connected, respectively.

The interrupter assembly may be installed in the case, and may be provided with an arc gas outlet for discharging arc gas generated from inside of the interrupter assembly to outside.

The exhaustion guiding portion may be disposed between the interrupter assembly and the terminal portion.

The exhaustion guiding portion may be provided with a discharge chamber therein, to thus provide an arc gas passage between the arc gas outlet and a vent chute of the terminal portion.

The exhaustion cover may be mounted to the case, with a structure to cover the exhaustion guiding portion, thereby blocking the arc gas passage.

In an aspect of the present invention, ribs may be formed at the exhaustion guiding portion serving as the arc gas passage of the case, and at an exhaustion cover corresponding to the conventional auxiliary case. As the case and the auxiliary case are coupled to each other, leakage of arc gas can be prevented.

The exhaustion cover may be provided with sealing recesses therein, and the exhaustion guiding portion may be provided therein with sealing ribs protruding from the case and inserted into the sealing recesses. A land portion formed between the sealing recesses may be engaged with the sealing rib.

The sealing ribs may include: first sealing ribs protruding from the case at an upstream side of the arc gas passage; and a second sealing rib protruding from the case at a downstream side of the arc gas passage.

The sealing ribs may be spaced from each other in a discharge direction of arc gas, and may be engaged with the land portions.

The sealing ribs and the land portions may be alternately arranged to be engaged with each other.

The sealing ribs for three phases may be spaced from each other.

The second sealing rib for one phase may be spaced from the second sealing rib for another phase. The second sealing rib may further include gas guiding portions extending from two ends of the second sealing rib toward the arc gas outlet.

The exhaustion cover may include: end plates; a plurality of sealing partitions; and protrusions.

The end plates may be protruding from two ends of the exhaustion cover, and may be inserted into the exhaustion guiding portions.

The sealing partitions may be protruding from an inner side surface of the exhaustion cover with an interval therebetween in a lengthwise direction.

The protrusions may be protruding from two ends of the sealing partition.

The protrusions may be configured to seal the discharge chamber divided into a plurality of regions for each phase.

The discharge chamber may be provided with a shielding member for separating inside of the case and the arc gas passage from each other.

The shielding member may be implemented as a plate. One end of the plate may be connected to the vent chute, and another end of the plate may be formed to be contactable to the arc gas outlet. Under such configuration, the shielding member can guide discharge of arc gas to the vent chute, from the arc gas outlet.

The exhaustion guiding portion may be provided with an insertion portion communicated with the discharge chamber with enclosing the arc gas outlet. The arc gas outlet can be inserted into the exhaustion guiding portion, through the insertion portion.

The land portion, formed between the sealing recesses, may be formed such that two edges thereof are rounded to enclose the insertion portion.

The molded case circuit breaker can have the following advantages.

Firstly, when the exhaustion cover is coupled to the case, arc gas can be prevented from leaking to a gap between the exhaustion cover and the case, through an engaged structure between the sealing ribs and the sealing recesses. Thus, arc gas can be rapidly discharged to outside.

Secondly, insulating properties between phases can be obtained through an engaged structure between the sealing partitions of the exhaustion cover and the third sealing recesses of the case.

Thirdly, due to the assembly protrusions formed at the exhaustion cover, an assembly characteristic between the case and the exhaustion cover can be enhanced.

Further, as the exhaustion guiding portion serving as a passage and inside of the case are separated from each other by the shielding member, arc gas can be prevented from being introduced into the case.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

The present invention relates to a sealing structure for preventing leakage of arc gas occurring when a short-circuit between phases occurs in a molded case circuit breaker.

Figure 1:
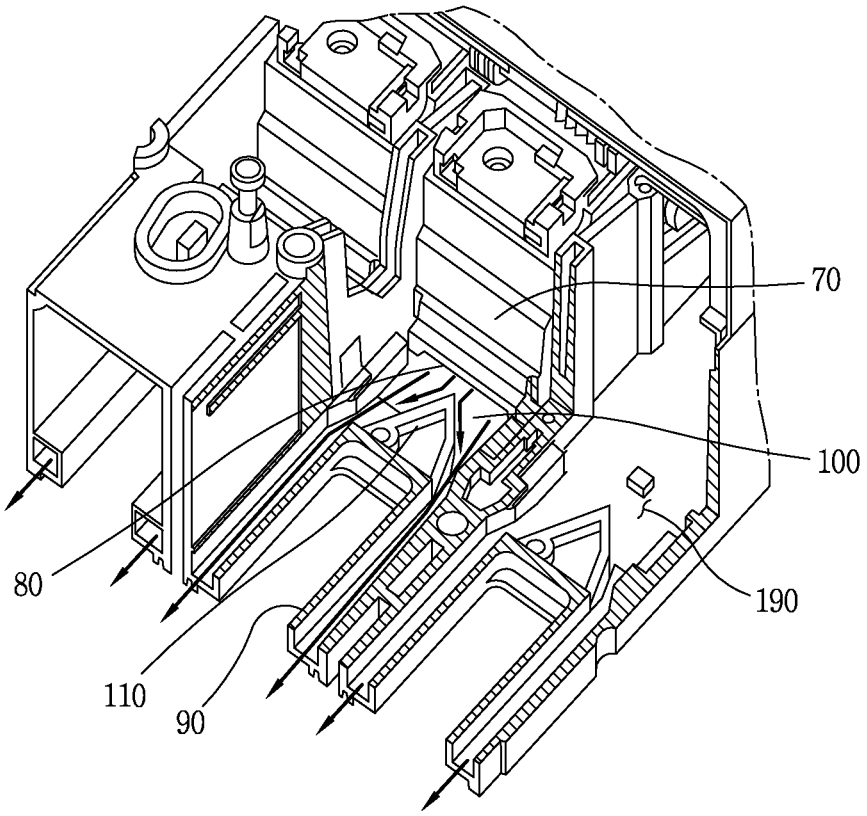
FIG. 1 PRIOR ART
FIG. 1 is a perspective view for explaining a vent means for a molded case circuit breaker according to the cited reference D1 of the prior art.
Figure 2:
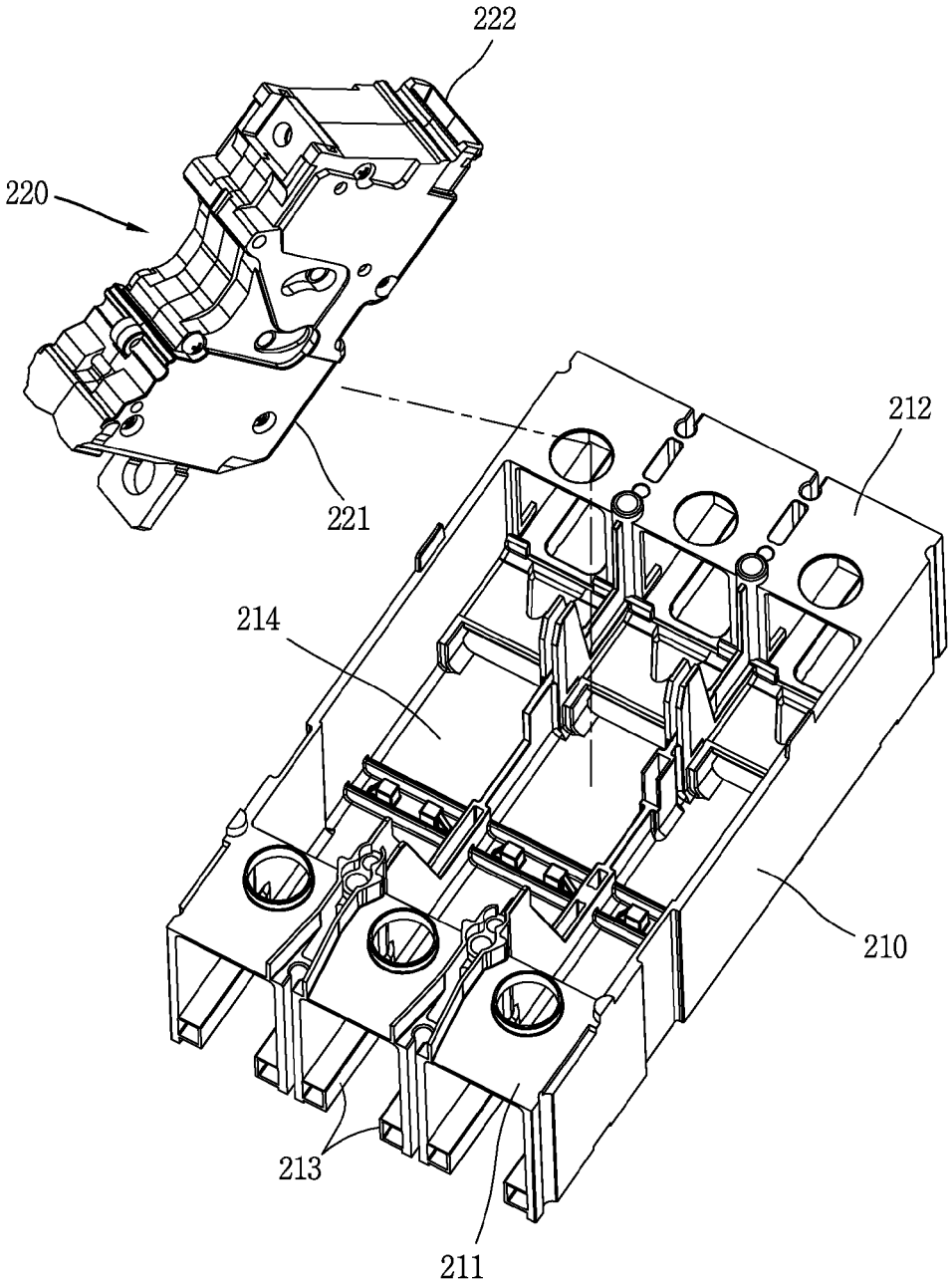
FIG. 2 is an exploded perspective view of a case and an interrupter assembly according to the present invention.
Figure 3:
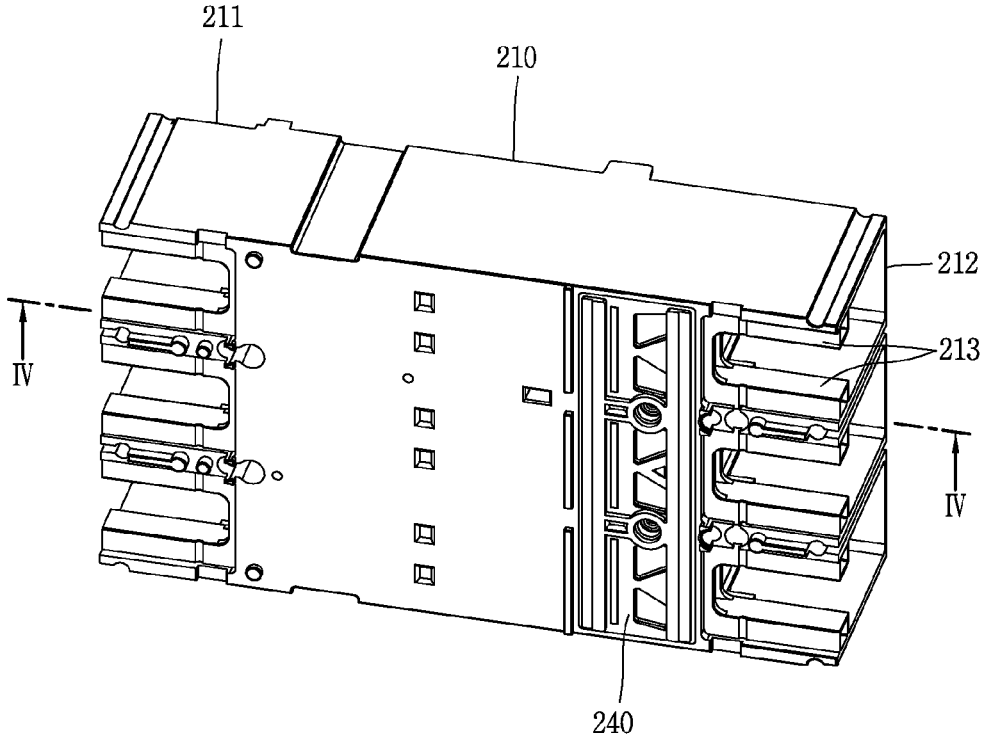
FIG. 3 is a bottom perspective view of a case according to the present invention.
Figure 4:
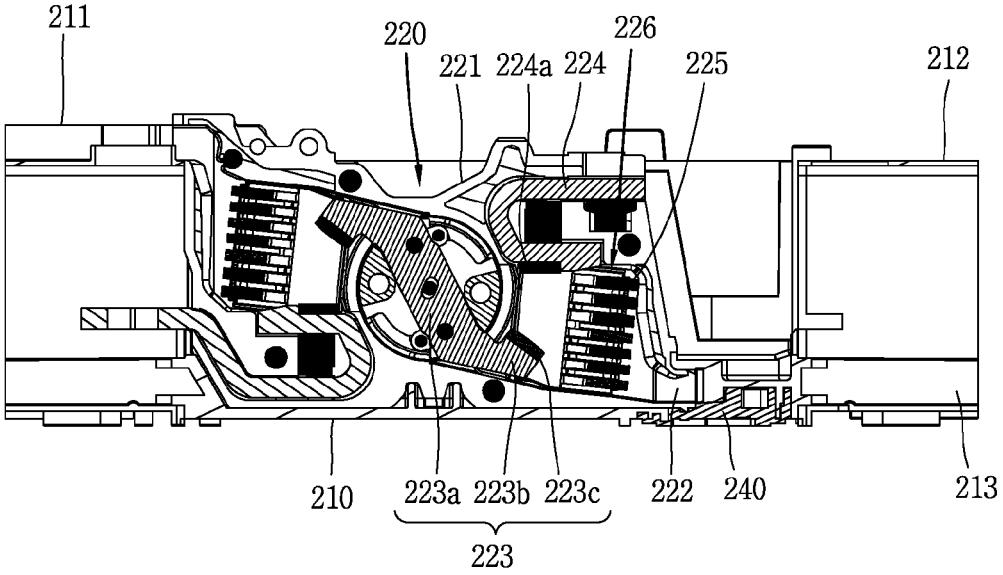
FIG. 4 is a sectional view taken along line 'IV-IV' in FIG. 3.

FIG. 2 is an exploded perspective view of a case and an interrupter assembly according to the present invention, FIG. 3 is a bottom perspective view of a case according to the present invention, and FIG. 4 is a sectional view taken along line 'IV-IV' in FIG. 3.

A molded case circuit breaker according to the present invention includes a case 210, an interrupter assembly 220, and an arc gas exhaustion system.

A molded case circuit breaker according to an embodiment of the present invention may be configured to have three phases of R, S and T.

The case 210 may be divided into an upper case and a lower case for which form appearance of the molded case circuit breaker. The upper case is provided with a handle for turning on/off the molded case circuit breaker, and is positioned at an upper side to thus serve as a cover. The lower case 210 accommodates therein components such as the interrupter assembly 220 and a trip unit. The lower case 210 is positioned at a lower side to thus serve as a body.

The lower case 210 has a rectangular shape. Under an assumption that a longer side is a lengthwise direction and a shorter side is a widthwise direction, a power side terminal portion 211 and a load side terminal portion 212 are provided at two ends of the lower case 210 in the lengthwise direction. The power side terminal portion 211 and the load side terminal portion 212 may be connected to a power and a load, respectively. Each of the power side terminal portion 211 and the load side terminal portion 212 has four closed sides, and is open in the lengthwise direction.

An inner space 214 for accommodating the interrupter assembly 220 is provided between the power side terminal portion 211 and the load side terminal portion 212. The inner spaces 214 for three-phase are divided from each other by partition walls formed in a lengthwise direction with intervals therebetween in a widthwise direction. Power sides of three-phase are connected to or disconnected from load sides of three-phase, independently. An upper surface of the inner space 214 is open.

The interrupter assembly 220 is provided for each of three phases. The interrupter assembly 220 is inserted into the inner space 214 additionally provided at the lower case 210, thereby contacting or separating a fixed contact and a movable contact for each phase to or from each other.

The interrupter assembly 220 includes a housing 221 divided to be symmetrical to each other right and left, based on a lengthwise center line; moving plates 223 and fixed plates 224 provided in the housing 221; and extinguishing units 226 for extinguishing arc gas.

The fixed plates 224 are fixed in the housing 221 in a diagonal direction, and fixed contacts **224*a* are fixed to one ends of the fixed plates 224. The fixed contact 224*a* is positioned within the range of a rotation radius of a movable contact 223*c* of the moving plate 223**.

The moving plate 223 may be composed of a moving plate body **223*a* having a center part rotatably-coupled to a shaft positioned at the center of the housing 221; moving plate arm portions 223*b* extending from the moving plate bodies 223*a* in opposite directions; and movable contacts 223*c* provided at ends of the moving plate arm portions 223*b*. The movable contact 223***c* is contactable to or separable from the fixed contact 224*a*, by being interworked with rotation of the moving plate 223.

The extinguishing unit 226 is provided with a plurality of grids 225 spaced from each other in a rotation direction of the moving plate 223 which moves far from the fixed plate 224. The extinguishing units 226 are positioned in the housing 221 near the fixed contacts 224*a* of the fixed plates 224, in a diagonal direction, thereby extinguishing arc generated between the movable contacts 223*c* and the fixed contacts 224*a*. The grids 225 are configured to guide an arc to be introduced into a gap therebetween. The grids 225 may cut an arc and extinguish the arc by moving the arc to ends thereof.

Figure 5:
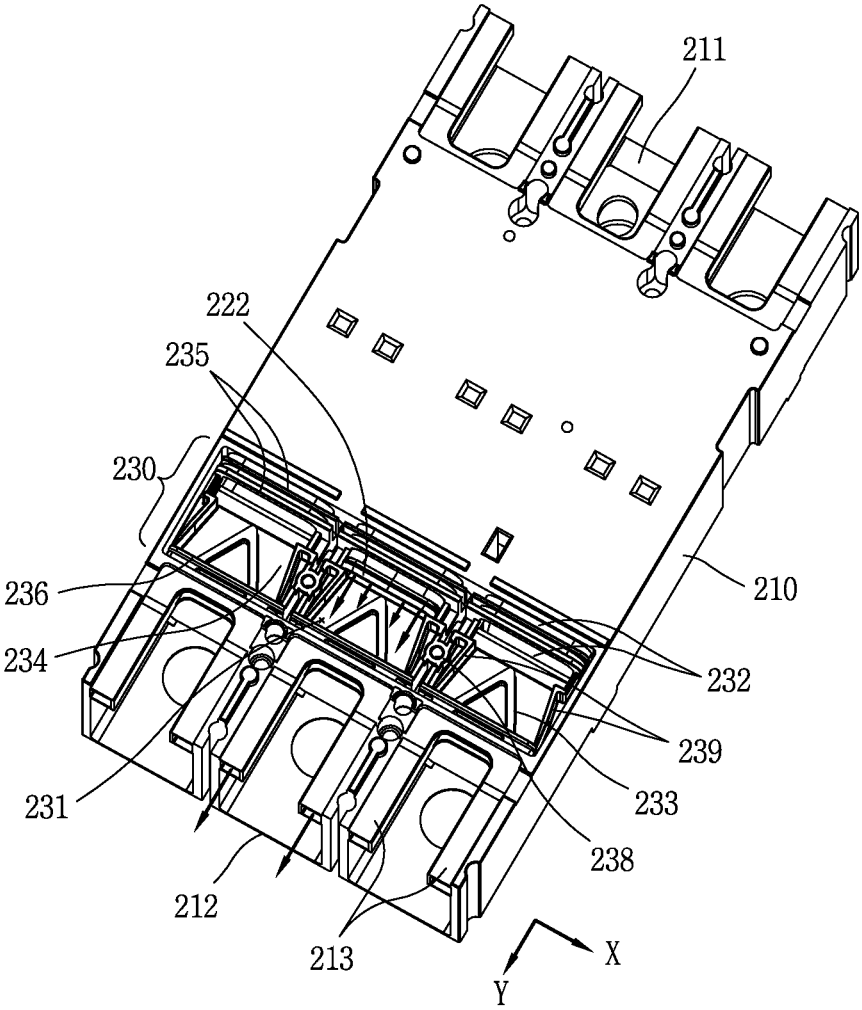
FIG. 5 is a bottom perspective view illustrating a state that an exhaustion cover of FIG. 3 has been detached from case.
Figure 6:
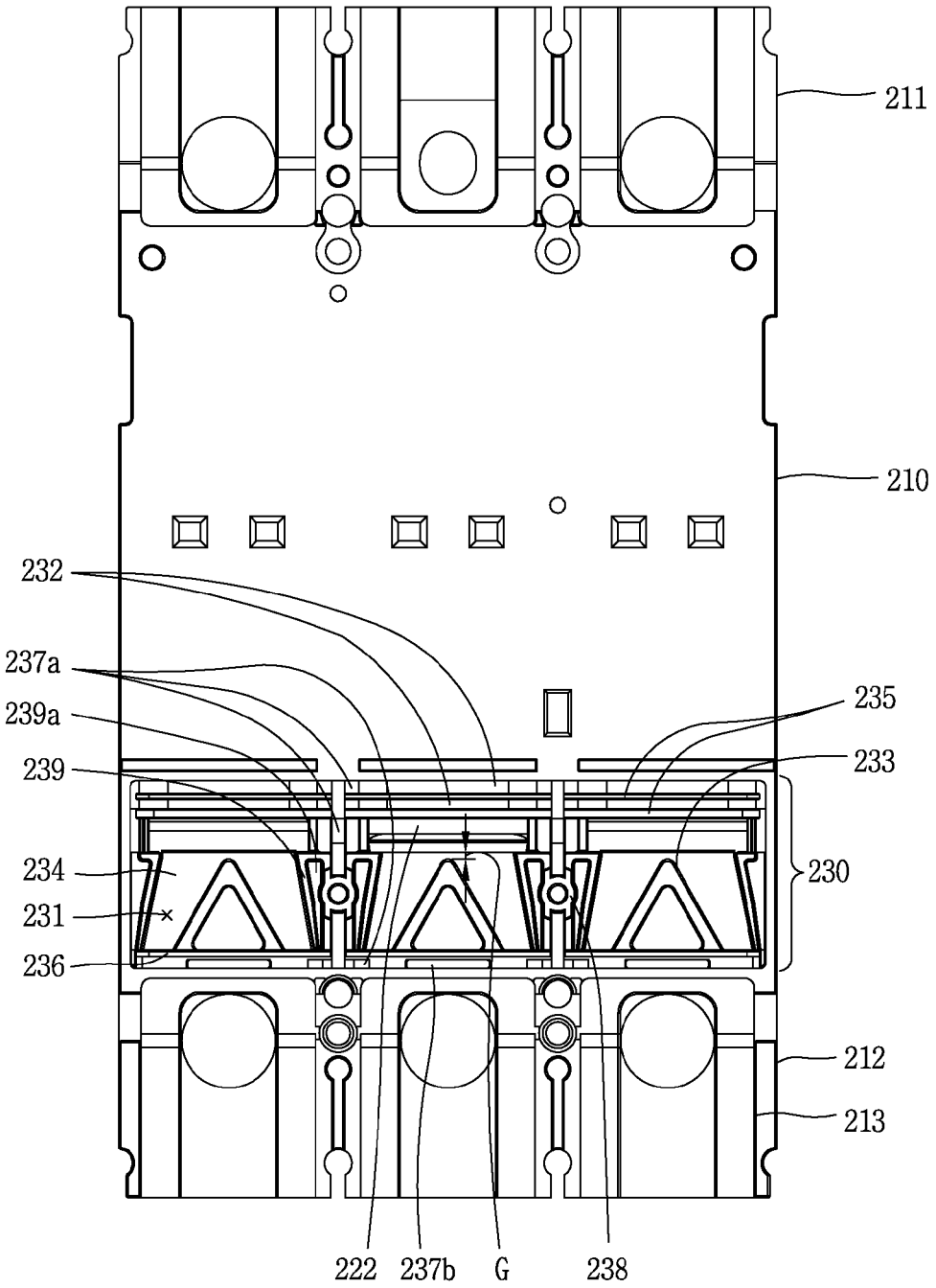
FIG. 6 is a bottom view of FIG. 5.
Figure 7:
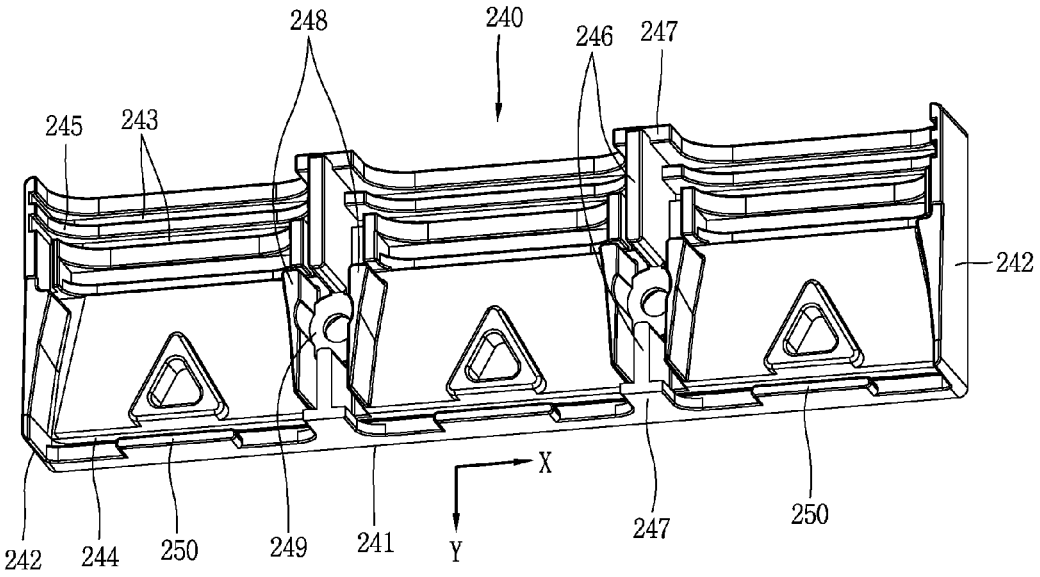
FIG. 7 is a perspective view illustrating an inner side surface of an exhaustion cover according to the present invention.
Figure 8:
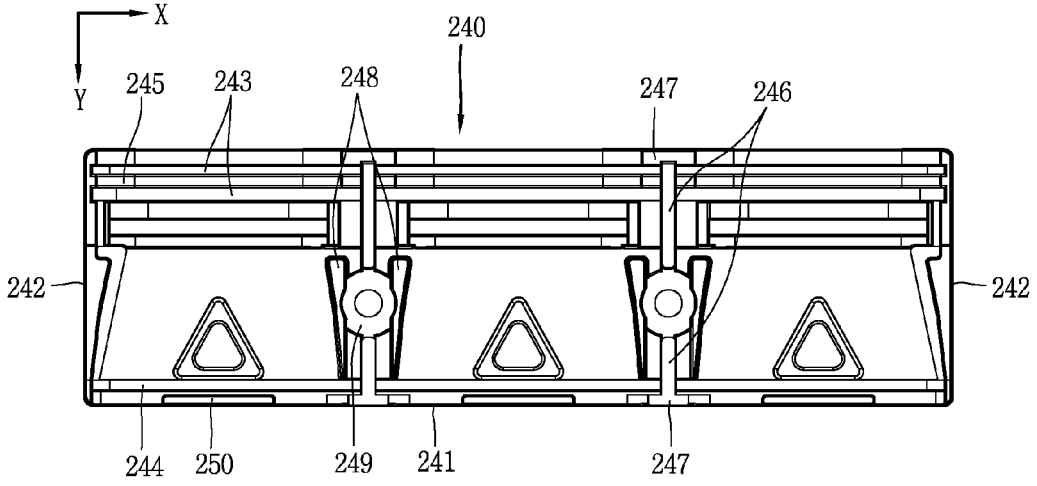
FIG. 8 is a planar view illustrating the inner side surface of the exhaustion cover of FIG. 7.

FIG. 5 is a bottom perspective view illustrating a state that an exhaustion cover of FIG. 3 has been detached from a case, FIG. 6 is a bottom view of FIG. 5, FIG. 7 is a perspective view illustrating an inner side surface of an exhaustion cover according to the present invention, and FIG. 8 is a planar view illustrating the inner side surface of the exhaustion cover of FIG. 7.

The arc gas exhaustion system may include an arc gas outlet 222 provided at a housing 221; a vent chute 213 provided at the load side terminal portion 212; and an exhaustion guiding portion 230 disposed between the arc gas outlet 222 and the vent chute 213.

The arc gas outlets 222 may be formed at two ends of the housing 221 so as to be adjacent to the extinguishing unit 226, so that arc gas generated between contacts in the interrupter assembly 220 can be discharged to outside through the arc gas outlet 222.

The power side terminal portion 211 and the load side terminal portion 212 are connected to an external power side terminal and an external load side terminal, respectively. A vent chute 213 is formed in a state where the load side terminal portion 212 is interposed therebetween, thereby discharging arc gas to outside.

The trip unit is installed in the case 210 so as to be adjacent to the load side terminal portion 212, and is disposed above the exhaustion guiding portion 230 to be explained later. The trip unit serves to automatically separate contacts from each other when a short-circuit has occurred.

The exhaustion guiding portion 230 is provided between the inner space 214 of the case 210 and the load side terminal portion 212. And the exhaustion guiding portion 230 is provided with a discharge chamber 231 disposed between the arc gas outlet 222 and the vent chute 213, and the discharge chamber 231 providing an arc gas passage.

The exhaustion guiding portion 230 is provided with a shielding member 234 spaced from a bottom surface of the lower case 210 which contacts an installation surface of the molded case circuit breaker, in a height direction. The shielding member 234 is configured to separate the inner space 214 of the case 210 and the discharge chamber 231 from each other. The shielding member 234 can prevent arc gas discharged to the discharge chamber from being introduced into the case 210, and can help the arc gas be rapidly discharged to outside through the vent chute 213.

The shielding member 234 has a plate structure. One end of the shielding member 234 comes in contact with the load side terminal portion 212, and another end thereof is horizontally-extending from the load side terminal portion 212 toward the arc gas outlet 222 to thus be contactable to the arc gas outlet 222.

An insertion portion 232 having a "ㄷ"-shaped sectional surface is formed at one side of the exhaustion guiding portion 230 (upstream side of an arc gas discharge direction (Y)), in a structure to enclose an outer side surface of the arc gas outlet 222. For instance, the arc gas outlet 222 has a closed quadrangular sectional surface. The insertion portion 232 is formed to enclose "ㄷ"-shaped three surfaces adjacent to each other, among outer side surfaces of the arc gas outlet 222. And the insertion portion 232 is formed to be communicated with the discharge chamber 231. Under such configuration, when the interrupter assembly 220 is inserted into the case 210, the arc gas outlet 222 is inserted into the insertion portion 232. As a result, arc gas generated from inside of the interrupter assembly 220 can be discharged to the discharge chamber 231.

The exhaustion guiding portion 230 is provided with a triangular gas divergence portion 233 configured to diverge arc gas discharged from the arc gas outlet 222 to two sides, and configured to guide flow of the arc gas to a pair of vent chutes 213 spaced from each other for each phase.

The gas divergence portion 233 is formed at the end of the shielding member 234 in the form of a triangle, so that the vertex of the triangle can be positioned on a center line of a width of the arc gas outlet 222. And the gas divergence portion 233 is spaced from the end of the arc gas outlet 222 by a predetermined interval (G) in a discharge direction of arc gas. Under such configuration, a flow resistance of arc gas can be minimized, and arc gas can be rapidly discharged to outside. A distance between the arc gas outlet 222 and the vertex of the gas divergence portion 233 is not limited. However, the arc gas outlet 222 and the vertex of the gas divergence portion 233 are preferably formed to have a distance therebetween, for a minimized gas flow resistance. According to experiments, a flow resistance is smaller than in a case where the distance between the arc gas outlet 222 and the vertex of the gas divergence portion 233 is zero.

The gas divergence portions 233 for three-phase are spaced from each other.

The exhaustion guiding portion 230 has an opening at a surface facing an installation surface of the molded case circuit breaker. In order to cover the opening, an exhaustion cover 240 is installed at the exhaustion guiding portion 230.

However, in a case where the exhaustion cover 240 (corresponding to an auxiliary case in the prior arts) is coupled to the case 210, arc gas may leak to a micro gap between the exhaustion cover 240 and the exhaustion guiding portion 230 of the case 210 to which the exhaustion cover 240 is coupled. In order to prevent such leakage, a sealing structure is required.

For the sealing structure with respect to arc gas according to the present invention, a plurality of engaging structures are formed between the exhaustion guiding portion 230 of the case 210 and the exhaustion cover 240. Under such structure, a leakage distance of arc gas into the micro gap becomes longer than the conventional one, and thus arc gas is prevented from leaking to outside.

Hereinafter, a sealing structure with respect to arc gas according to an embodiment of the present invention will be explained in more detail.

As aforementioned, the interrupter assembly 220 is provided for each of three phases, and is inserted into the inner space 214 of the case 210. When the exhaustion cover 240 is assembled to the case 210, the arc gas outlet 222 is inserted into the discharge chamber 231 through the insertion portion 232 of the exhaustion guiding portion 230.

A plurality of first sealing ribs 235 may be formed at the insertion portion 232 with intervals therebetween. The first sealing ribs 235 for one phase may be spaced from the first sealing ribs 235 for another phase in a width direction of the case 210 (vertical direction (X) of a gas discharge direction).

The exhaustion cover 240 includes a cover body 241 having a plate type and formed to be long in a direction (X) perpendicular to a gas discharge direction (Y); and end plates 242 protruding from two ends of the cover body 241 in a lengthwise direction, so as to be inserted into the case 210.

A plurality of sealing recesses, spaced from each other for each phase, are provided on an inner side surface of the exhaustion cover 240. The sealing recesses include first sealing recesses 243 and second sealing recesses 244 spaced from each other in the gas discharge direction (Y).

As the first sealing rib 235 is inserted into the first sealing recess 243, a land portion 245 formed between the first sealing recesses 243 is engaged with the first sealing rib 235.

A moving path of gas is increased when a depth of the first sealing recess 243 is increased, a protruded length of the first sealing rib 235 is increased, and the number of the first sealing ribs 235 is increased. Thus, a sealed state can be maintained, and a sealing property can be enhanced. Considering a structural complexity and spatial obtainment due to increase of the number of the first sealing ribs 235, the number of the first sealing ribs 235 is preferably at least 2~3.

The first sealing ribs 235 and the first sealing recesses 243 may be disposed at the exhaustion guiding portion 230 for each phase, with intervals therebetween.

A second sealing rib 236 may be protruding from the exhaustion guiding portion 230, so as to be spaced from the first sealing ribs 235 in the gas discharge direction (Y). The second sealing rib 236 for one phase may be spaced from the second sealing rib 236 for another phase. This means that the second sealing ribs 236 are spaced from each other in a direction (X) perpendicular to the gas discharge direction (Y).

The exhaustion cover 240 is detachably coupled to the case 210. Both of the first sealing ribs 235 and the second sealing ribs 236 serve to maintain a sealed state between the case 210 and the exhaustion cover 240. The first sealing ribs 235 are positioned at the exhaustion guiding portion 230, at an upstream side of the arc gas passage, i.e., near the arc gas outlet 222. On the other hand, the second sealing ribs 236 are positioned at the exhaustion guiding portion 230, at a downstream side of the arc gas passage.

As the second sealing recesses 244 are formed at a downstream side of the arc gas passage of the exhaustion cover 240, the second sealing ribs 236 are inserted into the second sealing recesses 244 to thus be engaged with each other.

A plurality of sealing partitions 246 are formed on an inner side surface of the exhaustion cover 240, so as to be spaced from each other in a lengthwise direction (direction (X) perpendicular to the gas discharge direction). As a result, an inner space of the exhaustion guiding portion 230 is divided into a plurality of regions, for each of three phases.

Protrusions 247 may be formed at two ends of the sealing partition 246 in a vertical direction, thereby insulating a conductive path due to an arc gas for each phase.

Third sealing recesses 237*a* are formed at the exhaustion guiding portion 230, in correspondence to the sealing partitions 246 and the protrusions 247. Under such configuration, the sealing partitions 246 and the protrusions 247 are inserted into the third sealing recesses 237*a*, thereby enhancing gas insulating properties between phases.

A first coupling portion 249 is provided in the middle of the sealing partition 246. A female screw thread is formed in the first coupling portion 249, thereby detachably coupling the exhaustion cover 240 thereto.

Gas guiding insertion portions 248 are protruding from the exhaustion cover 240 in a direction (X) perpendicular to the gas discharge direction, in a state where the first coupling portion 249 is interposed therebetween.

A gas divergence portion coupler of a triangular shape insertion portion is protruding between the gas guiding insertion portions 248.

The land portion 245 formed between the sealing recesses, and the protrusion 247 (upstream side of an arc gas passage) formed at the end of the sealing partition 246 are formed so that two ends thereof can be rounded. Under such configuration, the land portion 245 is coupled to the first sealing rib 235 with enclosing a rounded edge of the insertion portion 232, thereby removing a gap between the insertion portion 232 and the exhaustion cover 240. Thus, a sealed state between the case 210 and the exhaustion cover 240 can be enhanced.

Gas guiding portions 239 are formed to be spaced from each other, in a direction (X) perpendicular to the gas discharge direction, in a state where the gas divergence portion 233 is interposed therebetween. The gas guiding portions 239 are configured to guide arc gas diverged by the gas divergence portion 233, to move to the vent chute 213 without overflowing to the discharge chamber 231 of another phase.

The gas guiding portions 239 may be formed to have a shape of a right angle triangle having one tapered side surface. One end of the gas guiding portion 239 is extending to be contactable to two side surfaces of the arc gas outlet 222, and another end of the gas guiding portion 239 is formed to contact the second sealing rib 236. The gas guiding portions 239 are provided in one pair, for each phase. Among the gas guiding portions 239, the gas guiding portions 239, disposed at two ends of the exhaustion guiding portion 230 in a direction (X) perpendicular to the gas discharge direction, are spaced from inner wall surfaces of the exhaustion guiding portion 230. The rest gas guiding portions 239 are spaced from each other, in a state where a second coupling portion 238 and the first coupling portion 249 are interposed therebetween, the second coupling portion 238 laminated on the first coupling portion 249. A female screw thread is formed in the second coupling portion 238, and coupling bolts are coupled to the first coupling portion 249 and the second coupling portion 238, thereby coupling the exhaustion cover 240 to the case 210.

The gas guiding portion 239 is provided therein an insertion recess 239*a* of a right angle triangle, and the gas guiding insertion portion 248 is inserted into the insertion recess 239*a*, so that the gas guiding portion 239 and the gas guiding insertion portion 248 are engaged with each other. Thus, insulating properties between phases can be enhanced.

An assembly protrusion 250 is protruding for each phase, at a downstream side of an arc gas passage of the exhaustion cover 240. A fitting recess 237*b* is formed for each phase, at a downstream side of an arc gas passage of the exhaustion guiding portion 230. Under such configuration, when the exhaustion cover 240 is assembled to the case 210, the assembly protrusions 250 are inserted into the fitting recesses 237*b*. Thus, an assembly characteristic between the exhaustion cover 240 and the case 210 can be enhanced.

In the present invention, when the exhaustion cover 240 is coupled to the case 210, arc gas can be prevented from leaking to a gap between the exhaustion cover 240 and the case 210, through an engaging structure between the sealing ribs and the sealing recesses.

Further, through the engaging structure between the sealing partition 246 of the exhaustion cover 240 and the third sealing recess 237*a* of the case 210, insulating properties between phases can be obtained.

Further, due to the assembly protrusions 250 formed at the exhaustion cover 240, an assembly characteristic between the case 210 and the exhaustion cover 240 can be enhanced.

Further, as the exhaustion guiding portion 230 serving as a passage is separated from inside of the case 210 by the shielding member 234, arc gas can be prevented from being introduced into the case 210.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker, comprising:

a case provided with a power side terminal portion and a load side terminal portion to which a power side external terminal and a load side external terminal are connected, respectively;

an interrupter assembly installed in the case, and provided with an arc gas outlet for discharging arc gas generated from inside of the interrupter assembly to outside;

an exhaustion guiding portion disposed between the interrupter assembly and the terminal portion, and provided with a discharge chamber therein, to thus provide an arc gas passage between the arc gas outlet and a vent chute of the terminal portion; and an exhaustion cover mounted to the case with a structure to cover the exhaustion guiding portion, to thus block the arc gas passage, wherein the exhaustion cover is provided with sealing recesses therein, wherein the exhaustion guiding portion is provided therein with sealing ribs protruding from the case and inserted into the sealing recesses, and wherein a land portion formed between the sealing recesses is engaged with the sealing rib.

2. The molded case circuit breaker of claim 1, wherein the sealing ribs include:

first sealing ribs protruding from the case at an upstream side of the arc gas passage; and a second sealing rib protruding from the case at a downstream side of the arc gas passage.

3. The molded case circuit breaker of claim 1, wherein the sealing ribs are spaced from each other in a discharge direction of arc gas, and are engaged with the land portions.

4. The molded case circuit breaker of claim 1, wherein the sealing ribs and the land portions are alternately arranged to be engaged with each other.

5. The molded case circuit breaker of claim 1, wherein the sealing ribs are spaced from each other for each phase.

6. The molded case circuit breaker of claim 2, wherein the second sealing rib for one phase is spaced from the second sealing rib for another phase, and the second sealing rib further includes gas guiding portions extending from two ends of the second sealing rib toward the arc gas outlet.

7. The molded case circuit breaker of claim 5, wherein the exhaustion cover includes:

end plates protruding from two ends of the exhaustion cover, and inserted into the exhaustion guiding portions;

a plurality of sealing partitions protruding from an inner side surface of the exhaustion cover with an interval therebetween in a lengthwise direction; and protrusions protruding from two ends of the sealing partition, wherein the protrusions are configured to seal the discharge chamber divided into a plurality of regions for each phase.

8. The molded case circuit breaker of claim 1, wherein the discharge chamber is provided with a shielding member for separating inside of the case and the arc gas passage from each other.

9. The molded case circuit breaker of claim 1, wherein the shielding member is configured as a plate, wherein one end of the plate is connected to the vent chute, and another end of the plate is formed to be contactable to the arc gas outlet, and wherein the shielding member guides discharge of arc gas to the vent chute, from the arc gas outlet.

10. The molded case circuit breaker of claim 1, wherein the exhaustion guiding portion is provided with an insertion portion communicated with the discharge chamber with enclosing the arc gas outlet, and wherein the arc gas outlet is inserted into the exhaustion guiding portion, through the insertion portion.

11. The molded case circuit breaker of claim 10, wherein the land portion, formed between the sealing recesses, is formed such that two edges thereof are rounded to enclose the insertion portion.

12. The molded case circuit breaker of claim 5, wherein the exhaustion guiding portion is provided with an insertion portion communicated with the discharge chamber with enclosing the arc gas outlet, and wherein the arc gas outlet is inserted into the exhaustion guiding portion, through the insertion portion.

* * * * *